US006368648B1

(12) United States Patent
Bertram et al.

(10) Patent No.: US 6,368,648 B1
(45) Date of Patent: Apr. 9, 2002

(54) ADSORBENT FILTRATION SYSTEM FOR TREATING USED COOKING OIL OR FAT IN FRYING OPERATIONS

(75) Inventors: Bryan Bertram, Georgetown, IN (US); Chris Abrams, Louisville, KY (US); Jeffrey Kauffman, Cambridge, WI (US)

(73) Assignee: The Dallas Group of America, Inc., Whitehouse, NJ (US)

( * ) Notice: Subject to any disclaimer, the term of this patent is extended or adjusted under 35 U.S.C. 154(b) by 0 days.

(21) Appl. No.: 09/352,239

(22) Filed: Apr. 13, 2001

(Under 37 CFR 1.47)

(51) Int. Cl.[7] ..... C11B 3/00

(52) U.S. Cl. ..... 426/417; 210/DIG. 8; 426/330.6; 426/423

(58) Field of Search ..... 426/417, 423, 426/330.6; 210/DIG. 8

(56) References Cited

U.S. PATENT DOCUMENTS

| | | | | |
|---|---|---|---|---|
| 3,947,602 A | | 3/1976 | Clewell, Jr. et al. | |
| 3,977,973 A | | 8/1976 | Anderson | |
| 3,984,447 A | | 10/1976 | Cooper et al. | |
| 4,328,097 A | | 5/1982 | Whaley et al. | |
| 4,681,768 A | | 7/1987 | Mulflur et al. | |
| 4,957,758 A | * | 9/1990 | Dryftholt et al. | 426/330.6 |
| 4,988,440 A | | 1/1991 | Bernard et al. | |
| 5,006,356 A | | 4/1991 | Munson | |
| 5,045,200 A | | 9/1991 | Brook | |
| 5,049,264 A | | 9/1991 | Rosnack et al. | |
| 5,160,444 A | | 11/1992 | McFarland | |
| 5,179,891 A | | 1/1993 | Chiu | |
| 5,560,950 A | * | 10/1996 | Conte et al. | 426/330.6 |
| 5,597,600 A | | 1/1997 | Munson et al. | |
| 5,597,601 A | | 1/1997 | Griffin | |
| 5,620,897 A | | 4/1997 | Zappe | |
| 5,846,409 A | | 12/1998 | Zappe | |

* cited by examiner

*Primary Examiner*—George C. Yeung
(74) *Attorney, Agent, or Firm*—Elliot M. Olstein; Raymond J. Lillie

(57) ABSTRACT

A process for treating used cooking oil or fat by passing the used cooking oil or fat from a used cooking oil or fat source to a holding vessel, and contacting the used cooking oil or fat with a predetermined amount of purifying material upon accumulation of a first predetermined amount of the oil or fat in the holding vessel. The used cooking oil or fat and the purifying material then are passed from the holding vessel to a filter apparatus upon accumulation of a second predetermined amount of the oil or fat in the holding vessel. The second predetermined amount of oil or fat is greater than the first predetermined amount. Upon passing of the used cooking oil or fat and the purifying material from the holding vessel to the filter apparatus, the purifying material becomes entrained in the filter apparatus. The used cooking oil or fat then is passed from the filter apparatus to the source. After the oil or fat is treated, residual oil or fat and the used purifying material may be removed from the filter apparatus by blowing gas through the filter apparatus.

27 Claims, 1 Drawing Sheet

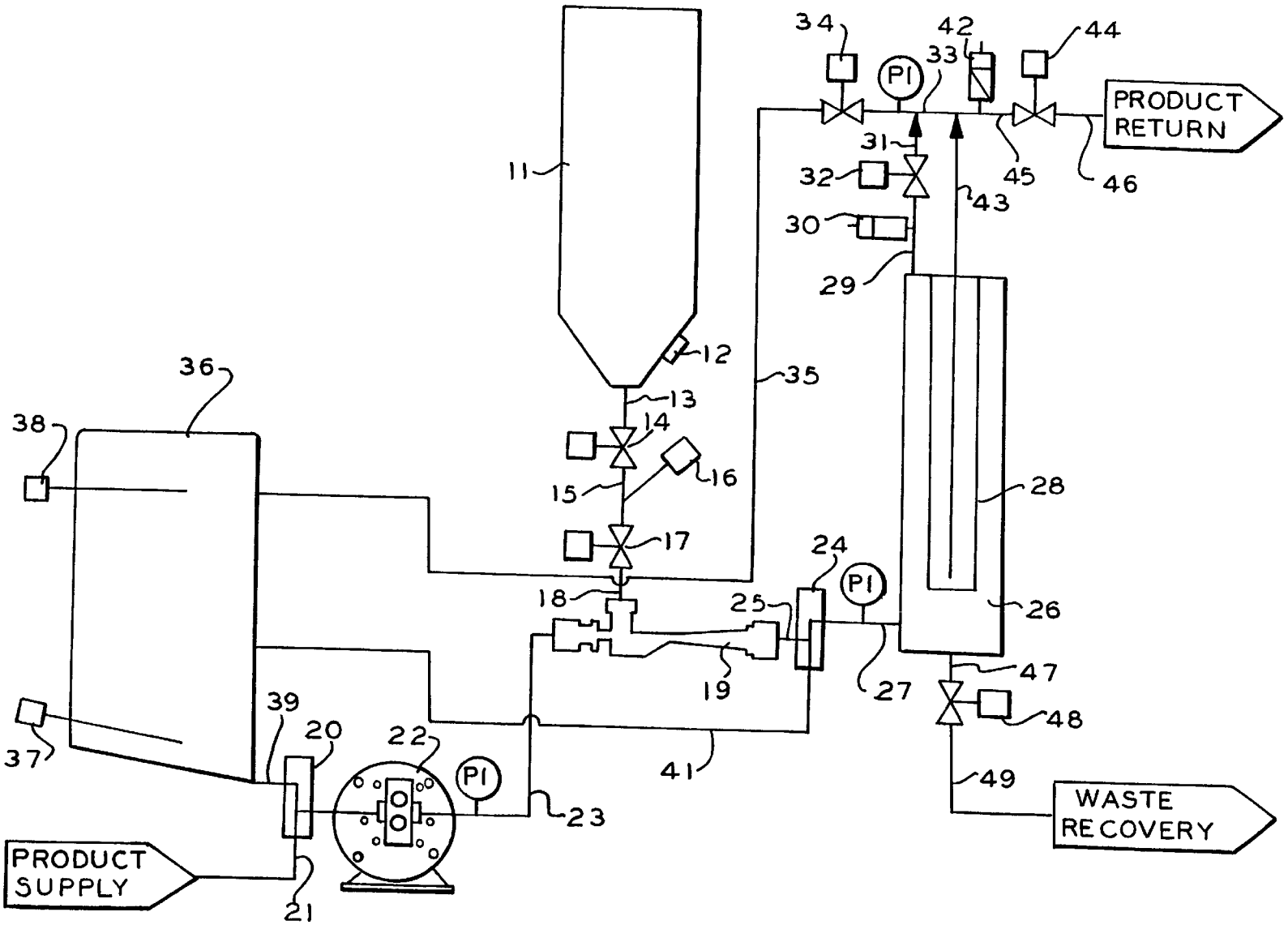
PRODUCT RETURN
WASTE RECOVERY
PRODUCT SUPPLY
PI
PI
PI

ADSORBENT FILTRATION SYSTEM FOR TREATING USED COOKING OIL OR FAT IN FRYING OPERATIONS

This invention relates to a process for treating used cooking oil or fat from frying operations such as industrial frying operations in order to remove impurities such as free fatty acids from the cooking oil or fat. More particularly, this invention relates to a system, preferably an automated system, for treating used cooking oil or fat that may be run continuously, thus providing for a more efficient process of treating used cooking oil.

Cooking oils and fats are employed in general for the cooking or frying of foods such as chicken, fish, potatoes, potato chips, vegetables, and pies. Such frying may take place in a restaurant wherein food is prepared for immediate consumption, or in an industrial frying operation where food is prepared in mass quantities for packaging, shipping, and future consumption.

In a typical restaurant frying operation, large quantities of edible cooking oils or fats are heated in vats to temperatures of from about 315° F. to about 400° F. or more, and the food is immersed in the oil or fat for cooking. During repeated use of the cooking oil or fat, the high cooking temperatures, in combination with water from the food being fried, cause the formation of free fatty acids (or FFA). An increase in the FFA decreases the oil's smoke point and results in increasing smoke as the oil ages.

Industrial frying operations involve the frying of large amounts of food for delayed consumption. Often, this is a continuous operation with the food being carried through the hot oil via a conveyor.

Industrial fryers of meat and poultry must follow the guidelines of the FDA Food Safety and Inspection Service (FSIS) Meat and Poultry Inspection Manual. The following are excerpts from that manual:

Section 18.40 Frying (a) Meat

Length of time fats and oils may be used for deep fat frying varies with temperature, quality of new fat added daily, and fat treatment during use. Suitability of these fats for further use can be determined from degree of foaming during use or from color, odor, and flavor.

Fat or oil should be discarded when it foams over the vessel's side during cooking, or when its color becomes almost black as viewed through a colorless glass container.

Section 18.40 Frying (b) Poultry (5) Fat Acceptability

Used fat may be made satisfactory by filtering, adding fresh fat, and cleaning the equipment regularly.

Large amounts of sediment and free fatty acid content in excess of 2 percent are usual indications that frying fats are unwholesome and require reconditioning or replacement.

Industrial fryers of meat and poultry, in general, use the 2% free fatty acid (FFA) limit, or less if mandated by their customers, as their main specification for oil quality.

In addition to hydrolysis, which forms free fatty acids, there occurs oxidative degeneration of fats which results from contact of air with hot oil, thereby producing oxidized fatty acids (or OFA). Heating transforms the oxidized fatty acids into secondary and tertiary by-products which may cause off-flavors and off-odors in the oil and fried food.

Caramelization also occurs during the use of oil over a period of time, resulting in a very dark color of the oil which, combined with other by-products, produces dark and unappealing fried foods.

Because of the cost resulting from the replacing of the cooking oils and fats after the use thereof, the food industries have searched for effective and economical ways to slow degradation of fats and oils in order to extend their usable life.

U.S. Pat. No. 4,112,129, issued to Duensing, et al., discloses a composition comprised of diatomite, synthetic calcium silicate hydrate, and synthetic magnesium silicate hydrate may be employed for reclaiming used fats and oil.

U.S. Pat. No. 4,681,768, issued to Mulflur, et al., discloses a process for treating used cooking oil or fat by contacting used cooking oil or fat with a high surface area amorphous synthetic magnesium silicate having a surface area of at least 300 square meters per gram.

U.S. Pat. No. 5,597,600, issued to Munson, et al., discloses the treatment of cooking oil or fat with magnesium silicate and at least one alkali material to reduce the content of free fatty acids in the oil or fat.

In present systems for treating used cooking oil or fat, however, the frying system is shut down periodically in order to remove the oil or fat from the fryer to a batch treatment tank where a purifying material is mixed for a specified time and then removed by filtration. The oil or fat then is ready to return to the fryer.

It is an object of the present invention to provide a filter system, which may be an automated system, for treating used cooking oil or fat wherein used cooking oil or fat may be treated continuously without shutting down the frying system.

In accordance with an aspect of the present invention, there is provided a process for treating used cooking oil or fat. The process comprises: (a)passing the used cooking oil or fat from a cooking oil or fat source to a holding vessel; (b)contacting the used cooking oil or fat with a predetermined amount of purifying material upon accumulation of a first predetermined amount of the oil or fat in the holding vessel; (c)passing the used cooking oil or fat and the purifying material from the holding vessel to a filter apparatus upon accumulation of a second predetermined amount of the oil or fat in the holding vessel, wherein the second predetermined amount of oil or fat is greater than the first predetermined amount of oil or fat, and whereby upon passing of the used cooking oil or fat and the purifying material from the holding vessel to the filter apparatus, the purifying material becomes entrained in the filter apparatus; and (d)passing the used cooking oil or fat from the filter apparatus to the source.

In one embodiment, step (a) comprises passing the used cooking oil or fat through a first transport line from said source to a first diverting valve. The used cooking oil or fat then is passed through a second transport line from said first diverting valve to a second diverting valve. The used cooking oil or fat then is passed through a third transport line from the second diverting valve to the filter apparatus, and the cooking oil or fat is passed through the filter apparatus and then through a fourth transport line from the filter apparatus to the holding vessel.

In another embodiment, in step (b), the used cooking oil or fat is contacted with the purifying material in the second transport line upon accumulation of the first predetermined amount of the cooking oil in the holding vessel. Upon contact of the used cooking oil or fat with the purifying material in the second transport line, the second diverting valve is diverted such that the used cooking oil or fat is passed from the source through the first transport line, the first diverting valve, the second transport line, the second diverting valve and through a fifth transport line from the second diverting valve to the holding vessel until the used cooking oil or fat is accumulated in the holding vessel at the second predetermined level.

In yet another embodiment, step (c) comprises diverting the first diverting valve such that the used cooking oil or fat and the purifying material are passed from the holding vessel to a sixth transport line from the holding vessel to the first diverting valve, and then are passed through the second transport line from the first diverting valve to the second diverting valve. The used cooking oil or fat and the purifying material then are passed through the third transport line to the filter apparatus. The used cooking oil or fat and the purifying material then are passed through the filter apparatus, whereby the purifying material becomes entrained in the filter apparatus. The used cooking oil or fat then is passed through the fourth transport line from the filter apparatus to the holding vessel.

In another embodiment, step (d) comprises diverting the first diverting valve such that the used cooking oil or fat is passed through the first transport line, the first diverting valve, the second transport line, the second diverting valve, and the third transport line to the filter apparatus. In general, the oil passes through the filter apparatus for a period of time of from about 10 minutes to about 20 minutes, preferably from about 15 minutes to about 20 minutes, more preferably about 20 minutes. The used cooking oil or fat then is passed through a seventh transport line from the filter apparatus to the source. The first diverting valve then is diverted such that the used cooking oil or fat contained in the holding vessel is passed from the holding vessel through the sixth transport line, the first diverting valve, the second transport line, the second diverting valve the third transport line, the filter apparatus, and the seventh transport line to the source or to a holding vessel which feeds the source.

In a preferred embodiment, residual oil or fat then is removed from the filter apparatus, and the residual oil or fat is passed from the filter apparatus to the holding vessel. The used purifying material then is removed from the filter apparatus.

In one embodiment, a gas is introduced into the filter apparatus, whereby the gas transports the residual oil from the filter apparatus to the holding vessel.

In another embodiment, a gas is introduced into the filter apparatus, whereby the gas removes the purifying material from the filter apparatus.

Examples of the gas, which may be employed in removing residual oil and/or the purifying material from the filter apparatus, include, but are not limited to, nitrogen and compressed air. In a preferred embodiment, the gas is nitrogen.

Purifying materials which may be employed include, but are not limited to, magnesium silicate; calcium silicate; activated carbon; silica gel; magnesium phosphate; and alkali materials such as alkaline earth metal hydroxides, alkaline earth metal oxides, alkaline metal carbonates, alkali metal bicarbonates, sodium sesquicarbonate, alkaline earth metal carbonates, and alkali metal silicates. The purifying material can include one or more of the above components.

In one embodiment, the purifying material comprises magnesium silicate.

In general, the magnesium silicate is a magnesium silicate which is acceptable as a filter aid in food processing applications. For example, the Food Chemical Codex, Third Edition, gives the following specifications for a synthetic magnesium silicate which is acceptable in food processing and industrial frying operations:

| | |
|---|---|
| Loss on Drying | 15% max |
| Loss on Ignition | 15% max (dry basis) |

-continued

| | |
|---|---|
| % MgO | 15% min. (ignited basis) |
| % $SiO_2$ | 67% min. (ignited basis) |
| Soluble salts | 3% max. |
| Mole ratio $MgO:SiO_2$ | 1:1.36 to 1:3.82 |

In one embodiment, the magnesium silicate is an amorphous synthetic magnesium silicate having a surface area of at least 300 square meters per gram, and preferably has a surface area from about 400 square meters per gram to about 700 square meters per gram, and more preferably has a surface area from about 400 square meters per gram to about 600 square meters per gram. In addition, such magnesium silicate is preferably employed as coarse particles, with at least 75%, and preferably at least 85% of the particles having a particle size which is greater than 400 mesh, and with no more than 15%, and preferably no more than 5%, all by weight, having a particle size greater than 40 mesh. In most cases, the average particle size of the magnesium silicate employed in accordance with the present invention is in the order of but not limited to 20–75 microns. It is to be understood, however, that the magnesium silicate may have a particle size different than the preferred size.

In addition, the hydrated magnesium silicate which is employed in accordance with a preferred embodiment of the present invention generally has a bulk density in the order of from 15–35 lbs./cu. ft., a pH of 7–10.8 (5% water suspension) and a mole ratio of MgO to $SiO_2$of 1:1.8 to 1:4.

The following is a specification and typical value for a magnesium silicate which is employed in accordance with a preferred embodiment of the present invention:

TABLE

| Parameter | Specification | Typical Value |
|---|---|---|
| Loss on Ignition at 900° C. | 15% max. | 12% |
| Mole Ratio $MgO:SiO_2$ | 1:2.25 to 1:2.75 | 1:2.60 |
| pH of 5% Water Suspension | 8.5 ± 0.5 | 8.5 |
| Soluble Salts % by wt. | 3.0 max. | 1.0% |
| Average Size, Microns | | 25 |
| Surface Area (B.E.T.) | 300 $M^2$/g(min.) | 400 |
| Refractive Index | | Approx. 1.5 |

A representative example of such a synthetic magnesium silicate having a surface area of at least 300 square meters per gram is available as Magnesol® Polysorb 30/40, a product of the Dallas Group of America, Inc., Whitehouse, N.J., and also is described in U.S. Pat. No. 4,681,768.

In another embodiment, the magnesium silicate is an amorphous, hydrous, precipitated synthetic magnesium silicate which has been treated to reduce the pH thereof to less than about 9.0. As used herein, the term "precipitated" means that the amorphous hydrated precipitated synthetic magnesium silicate is produced as a result of precipitation formed upon the contact of a magnesium salt and a source of silicate in an aqueous medium.

For purposes of the present invention, the pH of the magnesium silicate is the pH of the magnesium silicate as measured in a 5% slurry of the magnesium silicate in water. The pH of the treated magnesium silicate in a 5% slurry preferably is from about 8.2 to about 8.9, and more preferably from about 8.5 to about 8.8, and most preferably is about 8.5. Examples of such a treated amorphous hydrous precipitated synthetic magnesium silicate are available as Magnesol® XL and Magnesol® Dalsorb® F, products of the Dallas Group of America, Inc., Whitehouse, N.J., and also are described in U.S. Pat. No. 5,006,356.

In yet another embodiment, the magnesium silicate is a magnesium silicate which has a surface area of from about 50 square meters per gram to about 150 square meters per gram. Preferably, such a magnesium silicate has a mole ratio of MgO to $SiO_2$ of from about 2:2.6 to about 1:3.4, and a pH (5% water suspension) of from about 9.5 to about 10.5. An example of such a magnesium silicate is available as Magnesol® HMR-LS, a product of the Dallas Group of America, Inc., Whitehouse, N.J.

In a further embodiment, the magnesium silicate has a pH (5% water suspension) of from about 9.0 to about 9.5.

In another embodiment, the magnesium silicate may be in the form of talc.

It is to be understood, however, that the scope of the present invention is not to be limited to any specific type of magnesium silicate or method for the production thereof In one embodiment, in addition to magnesium silicate, the purifying material further comprises at least one alkali material selected from the group consisting of alkaline earth metal hydroxides, alkaline earth metal oxides, alkali metal carbonates, alkali metal bicarbonates, sodium sesquicarbonate, alkaline earth metal carbonates, and alkali metal silicates.

In one embodiment, the ratio of magnesium silicate to alkali material in the purifying material is generally at least 1.8:1, preferably at least 9:1, and generally does not exceed 32:1, and in most cases does not exceed 19:1, all by weight. Thus, in a preferred embodiment, based on the two components, the magnesium silicate is present in the purifying material in an amount of from about 65 wt. % to about 97 wt. %, preferably from about 90 wt. % to about 95 wt. %.

In one embodiment, the at least one alkali material is an alkaline earth metal hydroxide.

Preferably, the alkaline earth metal hydroxide is calcium hydroxide ($Ca(OH)_2$).

In another embodiment the at least one alkali material is an alkaline earth metal oxide. Alkaline earth metal hydroxides which may be employed include, but are not limited to, magnesium oxide (MgO) and calcium oxide (CaO).

In another embodiment, the at least one alkali material is an alkali metal carbonate. Alkali metal carbonates which may be employed include, but are not limited to, sodium carbonate ($Na_2CO_3$).

In another embodiment, the at least one alkali material is an alkali metal bicarbonate. Alkali metal bicarbonates which may be employed include, but are not limited to, sodium bicarbonate ($NaHCO_3$), and potassium bicarbonate ($KHCO_3$).

In yet another embodiment, the at least one alkali material is sodium sesquicarbonate ($Na_2CO_3.NaHCO_3.2H_2O$).

In another embodiment, the at least one alkali material is an alkaline earth metal carbonate. Alkaline earth metal carbonates which may be employed include, but are not limited to, calcium carbonate ($CaCO_3$).

In another embodiment, the at least one alkali material is an alkali metal silicate.

Alkali metal silicates which may be employed include, but are not limited to, sodium metasilicate ($Na_2SiO_3$).

In another embodiment, the at least one alkali material is present in the purifying material in an amount of from about 3 wt. % to about 35 wt. %, preferably from about 5 wt. % to about 20 wt. %, with the remainder being magnesium silicate, based on the two components.

The process of the present invention is applicable particularly to industrial flying operations. In one embodiment, at least 1 wt. % of the purifying material is added, based on the weight of the used cooking oil or fat, to the used cooking oil or fat, preferably at least 1.5 wt. % of the purifying material is added, based on the weight of the used cooking oil or fat. In general, the amount of purifying material employed does not exceed 2 wt. %, based on the weight of the used cooking oil or fat.

In another embodiment, the purifying material comprises calcium silicate.

In yet another embodiment, the purifying material comprises activated carbon.

In still another embodiment, the purifying material comprises silica gel.

In a further embodiment, the purifying material comprises magnesium phosphate.

It is to be understood, however, that the scope of the present invention is not to be limited to any specific purifying materials.

The selection of an optimum amount of purifying material is dependent upon a variety of factors, including, but not limited to, the frequency of the treatments and the condition of the oil and the products fried. The purifying material is employed in an amount effective to reduce free fatty acid or color or other contaminant levels so as to extend the period of use of the oil. The maximum amount will be determined by required oil quality, economics, and filtration flow properties in the operation.

The invention now will be described with respect to the drawing, wherein:

The drawing is a schematic of an embodiment of the process of the present invention.

Filling of Powder Hopper

Referring now to the drawing, a purifying material, in the form of powder, is placed in hopper 11. Vibrator 12 then is turned on to settle the powder in the hopper 11. Valve 14 opens, and a predetermined amount of the powder, employed in treating the used cooking oil, passes from hopper 11 into line 13, through valve 14, and into line 15. Once the powder has filled line 15, valve 14 closes.

Filling of System with Oil

Diverting valve 20 is positioned such that used cooking oil is drawn from an oil source, such as an industrial fryer (not shown). Valves 32 and 34 also are opened. The oil travels through line 21, valve 20, pump 22, line 23, and into induction jet 19. The oil then travels through line 25, and through diverting valve 24, which has been positioned to enable the passage of the oil into and through line 27 to filter apparatus 26. The oil passes through filter apparatus 26 and filter 28 contained therein, and through line 29, valve 32, line 31, as well as through line 43 to line 33, valve 34, and line 35, and enters holding tank 36. Holding tank 36 includes sensor 37, which senses the amount of oil in holding tank 36 at a first level, and sensor 38, which senses the amount of oil at a second level.

Filter apparatus 26 includes a filter 28. Filter 28 may be any kind of filter which is capable of retaining the purifying material upon the filter such that the purifying material may form a filter cake upon the filter. In one embodiment, the filter is a cylindrical wire filter having openings having a size of from about 20 microns to about 50 microns. In a preferred embodiment, the filter is a cylindrical filter having triangular wire or "wedge wire," and having openings having a size of 50 microns or smaller. It is to be understood, however, that the scope of the present invention is not to be limited to any specific filter.

Dosing Of Powder In Oil

When the amount of oil in holding tank 36 is at the first level as detected by sensor 37, and when sensor 16 detects the presence of powder in line 15, valves 32 and 34 are closed and diverting valve 24 diverts flow back to tank 36 through line 41. Valve 17 then opens and the powder passes from line 15, through valve 17 and line 18, and into injection jet 19, in which the powder contacts the used cooking oil. The mixture of powder and used cooking oil is passed from induction jet 19 to line 25, through diverting valve 24 and line 41 and into holding tank 36.

Deposition Of Powder On Filter

When the amount of oil in holding tank 36 reaches the second level as detected by sensor 38, valve 34 opens and diverting valve 20 diverts so that oil is drawn from holding tank 36 through line 39 and diverting valve 20 instead of from the source through line 21 and diverting valve 20, and diverting valve 24 diverts so that the oil flows through line 27 instead of line 41. This directs the oil flow from holding tank 36 to flow through line 39, diverting valve 20, pump 22, line 23, induction jet 19, line 25, diverting valve 24, line 27, filter apparatus 26, line 43, line 33, valve 34, line 35 and back to holding tank 36. The mixture of powder and oil is pumped through filter 28 whereby the powder contacts filter 28 and becomes entrained on filter 28 forming a filter cake.

Filtration Of Oil From Source

After a period of about 4 minutes, valve 44 opens, valve 34 closes, and oil is drawn from holding tank 36. Oil is pumped from holding tank 36 through line 39 until sensor 37 is not in contact with oil, at which time diverting valve 20 diverts to draw oil from the oil source rather than holding tank 36. The oil passes through line 21, diverting valve 20, pump 22, line 23, induction jet 19, line 25, diverting valve 24, line 27, and through filter apparatus 26. As the oil passes through the filter cake formed on filter 28, the powder removes free fatty acids, color, and other impurities from the used frying oil. The oil leaves filter apparatus 28 through line 43 to line 45, through valve 44, line 46, and then to the source or a designated storage vessel, from which the oil is fed back to the source.

Discharge Of Oil And Filter Cake From System

After 20 minutes of continuous oil flow through filter apparatus 28, diverting valve 20 diverts so that oil is drawn from holding tank 36 and pumped through line 39. At this time, diverting valve 24 diverts oil flow through line 41, back to holding tank 36. This maintains oil flow through pump 22 and induction jet 19. Also at this time, air blow check valve 30 opens. After 1 minute of passing compressed air, or preferably nitrogen, through valve 30, thereby "drying" the filter cake formed on filter 28, valves 44 and 30 are closed. Air blow check valve 42 opens, and valve 48 opens. Air blow check valve 42 then blows air, or preferably nitrogen, into line 45. The air travels from line 45 to line 43, which extends into filter 28 of filter apparatus 26. The air exits line 43 inside filter 28 with sufficient force such that the air removes the filter cake of powder from filter 28. The filter cake moves downwardly by the force of gravity through filter apparatus 26 and exits filter apparatus 26 through line 47. The filter cake then passes through valve 48 and line 49 to a waste recovery bin for containing spent powder (not shown). Once the filter cake is sent to the recovery bin, valves 44 and 48 are closed and the system is reset to fill the system once again with powder and oil to start another cycle of treatment.

The disclosure of all patents, publications, including published patent application, referenced in this specification are specifically incorporated by reference in their entireties to the same extent as if each such individual patent and publication were specifically and individually indicated to be incorporated by reference.

It is to be understood, however, that the scope of the present invention is not to be limited to the specific embodiments described above. The invention may be practiced other than as particularly described and still be within the scope of the accompanying claims.

What is claimed is:

1. A process for treating used cooking oil or fat comprising:

(a) passing said used cooking oil or fat from a used cooking oil or fat source to a holding vessel;

(b) contacting said used cooking oil or fat with a predetermined amount of purifying material upon accumulation of a first predetermined amount of said oil or fat in said holding vessel;

(c) passing said used cooking oil or fat and said purifying material from said holding vessel to a filter apparatus upon accumulation of a second predetermined amount of said oil or fat in said holding vessel, said second predetermined amount of oil or fat being greater than said first predetermined amount of oil or fat, and whereby upon passing of said used cooking oil or fat and said purifying material from said holding vessel to said filter apparatus, said purifying material becomes entrained in said filter apparatus; and (d) passing said used cooking oil or fat from said filter apparatus to said source.

2. The process of claim 1 wherein step (a) comprises:

(i) passing said used cooking oil or fat through a first transport line from said source to a first diverting valve;

(ii) passing said used cooking oil or fat through a second transport line from said first diverting valve to a second diverting valve;

(iii) passing said used cooking oil or fat through a third transport line from said second diverting valve to said filter apparatus; and (iv) passing said used cooking oil or fat through said filter apparatus and through a fourth transport line from said filter apparatus to said holding vessel.

3. The process of claim 2 wherein, in step (b), said used cooking oil or fat is contacted with said purifying material in said second transport line upon accumulation of said first predetermined amount of said cooking oil in said holding vessel, and upon contact of said used cooking oil or fat with said purifying material in said second transport line, said second diverting valve is diverted such that said used cooking oil or fat is passed from said source through said first transport line, said first diverting valve, said second transport line, said second diverting valve, and through a fifth transport line from said second diverting valve to said holding vessel until said used cooking oil or fat is accumulated in said holding vessel at said second predetermined level.

4. The method of claim 3 wherein step (c) comprises:

(i) diverting said first diverting valve such that said used cooking oil or fat and said purifying material are passed from said holding vessel to a sixth transport line from said holding vessel to said first diverting valve;

(ii) passing said used cooking oil or fat and said purifying material through said second transport line from said first diverting valve to said second diverting valve;

(iii) passing said used cooking oil or fat and said purifying material through said third transport line to said filter apparatus;

(iv) passing said used cooking oil or fat and said purifying material through said filter apparatus, whereby said purifying material becomes entrained in said filter apparatus; and (v) passing said used cooking oil or fat through said fourth transport line from said filter apparatus to said holding vessel.

5. The process of claim 4 wherein step (d) comprises:

(i) diverting said first diverting valve such that said used cooking oil or fat is passed through said first transport line, said fist diverting valve, said second transport line, said second diverting valve, and said third transport line to said filter apparatus;

(ii) passing said used cooking oil or fat through a seventh transport line from said filter apparatus to said source; and (iii) diverting said first diverting valve such that said used cooking oil or fat contained in said holding vessel is passed from said holding vessel through said sixth transport line, said first diverting valve, said second transport line, said second diverting valve, said third transport line, said filter apparatus, and said seventh transport line to said source.

6. The process of claim 1 wherein said source is a fryer.

7. The process of claim 1 wherein said purifying material comprises magnesium silicate.

8. The process of claim 7 wherein said magnesium silicate has a surface area of at least 300 square meters per gram.

9. The process of claim 8 wherein said magnesium silicate has a surface area of at least 400 to about 700 square meters per gram.

10. The process of claim 8 wherein said magnesium silicate has a particle size such that at least 75% of the particles have a size greater than 400 mesh and no more than 15% have a particle size greater than 40 mesh.

11. The process of claim 8 wherein said magnesium silicate has a particle size of from about 20 microns to about 75 microns.

12. The process of claim 8 wherein said magnesium silicate has a bulk density of from about 25 to about 32 pounds per cubic foot.

13. The process of claim 7 wherein said magnesium silicate is an amorphous hydrous precipitated synthetic magnesium silicate, said magnesium silicate having been treated to reduce the pH thereof to less than about 9.0.

14. The process of claim 13 wherein said magnesium silicate has a pH in a 5% slurry of from about 8.2 to about 8.9.

15. The process of claim 14 wherein said magnesium silicate has a pH in a 5% slurry of from about 8.5 to about 8.8.

16. The process of claim 7 wherein said magnesium silicate has a surface area of from about 50 square meters per gram to about 150 square meters per gram.

17. The process of claim 16 wherein said magnesium silicate has a mole ratio of MgO to $SiO_2$ of from about 1:2.6 to about 1:3.4 and a pH in a 5% water suspension of from about 9.5 to about 10.5.

18. The process of claim 7 wherein said magnesium silicate has a pH of from about 9.0 to about 9.5.

19. The process of claim 7 wherein said purifying material further comprises at least one alkali material selected from the group consisting of alkaline earth metal hydroxides; alkaline earth metal oxides; alkali metal carbonates; alkali metal bicarbonates; sodium sesquicarbonate; alkaline earth metal carbonates; and alkali metal silicates.

20. The process of claim 19 wherein the ratio of said magnesium silicate to said at least one alkali material is at least 1.8:1 and no greater than 32:1, all by weight.

21. The process of claim 20 wherein the ratio of said magnesium silicate to said at least one alkali material is at least 9:1 and no greater than 19:1, all by weight.

22. The process of claim 19 wherein said at least one alkali material is an alkaline earth metal hydroxide.

23. The process of claim 22 wherein said alkaline earth metal hydroxide is calcium hydroxide.

24. The process of claim 19 wherein said at least one alkali material is sodium sesquicarbonate.

25. The process of claim 1, and further comprising:

(e) removing residual oil or fat from said filter apparatus and passing said residual oil or fat from said filter apparatus to said holding vessel; and (f) removing said purifying material from said filter apparatus.

26. The process of claim 25 wherein said step (e) comprises introducing a gas into said filter apparatus, whereby said gas transports said residual oil from said filter apparatus to said holding vessel.

27. The process of claim 25 wherein said step (f) comprises introducing a gas into said filter apparatus, whereby said gas removes said purifying material from said filter apparatus.

* * * * *